United States Patent [19]

Nirenberg et al.

[11] Patent Number: 5,035,192

[45] Date of Patent: Jul. 30, 1991

[54] BUTTON GUIDE TURNING ASSEMBLY

[75] Inventors: Morris Nirenberg, N. Woodmere; Jerry Tucci, Carle Place, both of N.Y.

[73] Assignee: RASI Corporation, Oceanside, N.Y.

[21] Appl. No.: 553,868

[22] Filed: Jul. 16, 1990

[51] Int. Cl.[5] ..... D05B 3/22

[52] U.S. Cl. ..... 112/110; 112/113; 112/265.1

[58] Field of Search ..... 112/106, 108, 109, 110, 112/111, 112, 113, 265.1

[56] References Cited

U.S. PATENT DOCUMENTS

| | | | |
|---|---|---|---|
| 3,123,251 | 3/1964 | Schneider | 112/113 X |
| 3,151,586 | 10/1964 | Medoff et al. | 112/113 |
| 3,363,805 | 1/1968 | Prezes | 112/113 X |
| 3,382,824 | 5/1968 | Bronfman | 112/113 |
| 4,651,657 | 3/1987 | Kennedy | 112/113 |
| 4,690,077 | 9/1987 | Nirenberg | 112/113 |

FOREIGN PATENT DOCUMENTS

| | | | |
|---|---|---|---|
| 1816135 | 7/1969 | Fed. Rep. of Germany | 112/110 |

*Primary Examiner*—Werner H. Schroeder
*Assistant Examiner*—Paul C. Lewis
*Attorney, Agent, or Firm*—Amster, Rothstein & Ebenstein

[57] ABSTRACT

A button guide turning assembly for automatic button delivery system for delivering buttons from a button supply serially in a given orientation to button affixing apparatus includes a pair of elongate, spaced apart parallel button guides together defining a channel through which the buttons pass in the automatic button feeding system. One of the button guides exerts greater friction on the buttons than the other of the guides, thereby to cause the buttons to rotate. In order to facilitate appropriate spacing of the button guides for buttons of different diameter, a pair of elongate, spaced apart, parallel calibration elements together define at least one button-receiving area. Each calibration element is secured to respective one of the guides for movement as a unit therewith and is configured and dimensioned such that, when the two calibration elements abut a button in the button-receiving area, the guides are appropriately positioned to pass buttons of like diameter through the channel.

9 Claims, 2 Drawing Sheets

FIG. 1
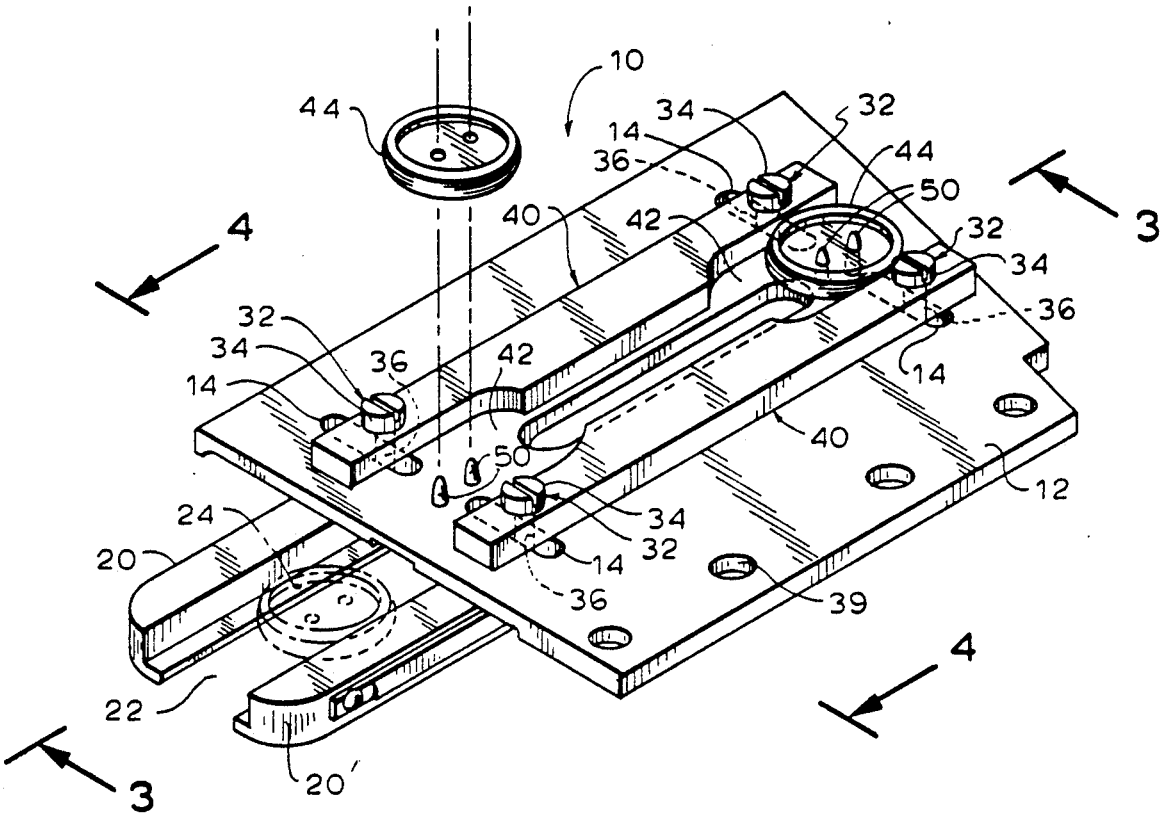
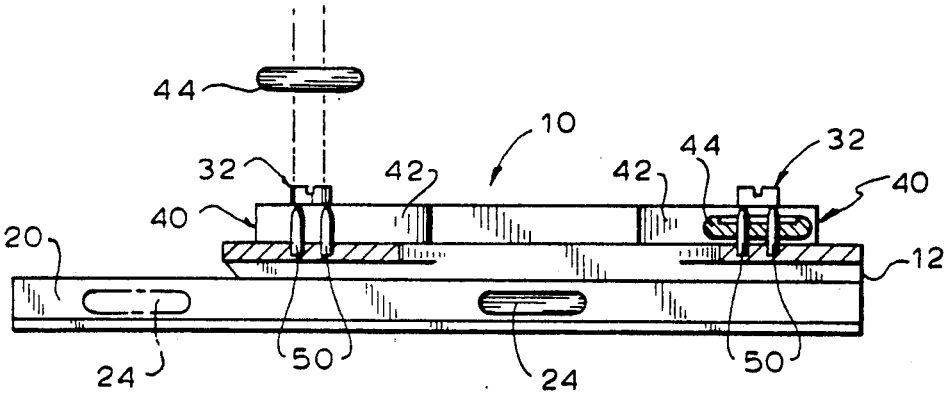
FIG. 3

FIG. 2
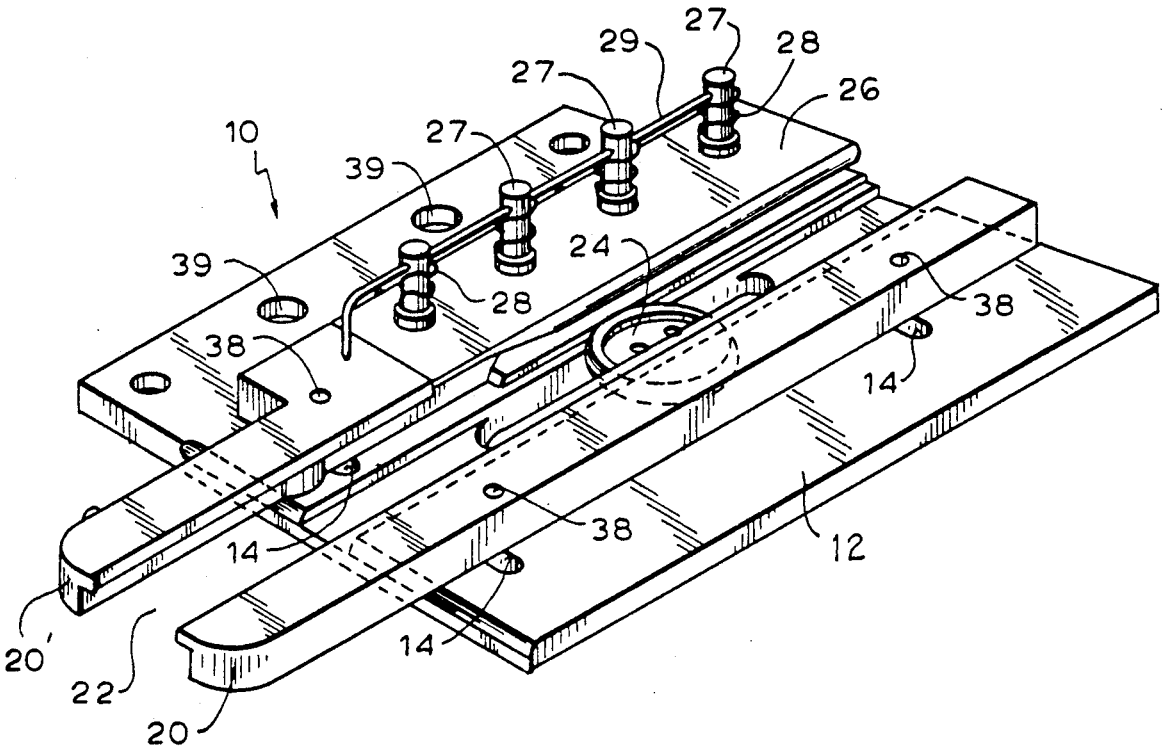
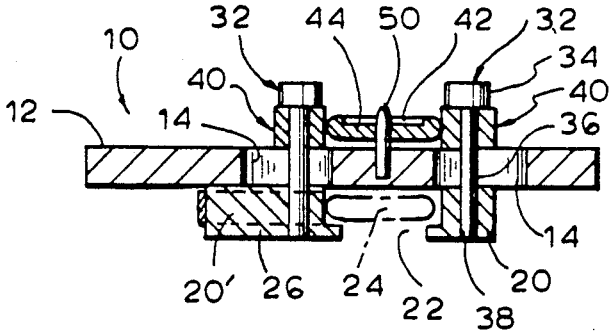
FIG. 4

BUTTON GUIDE TURNING ASSEMBLY

BACKGROUND OF THE INVENTION

The present invention relates to a button delivery system, and more particularly to a button guide turning assembly for an automatic button delivery system for delivering buttons from a button supply serially in a given orientation to a button affixing apparatus.

The many articles, such as clothes, which include buttons have resulted in the need for manufacturers to have economical operations for sewing the buttons on the articles rapidly and repetitively. A system for sewing buttons on articles preferably has the button positioned automatically on the article and with respect to a sewing machine, so that the sewing needle can pass through the holes in the button for sewing the buttons onto the article. Misalignment of the sewing needle with respect to the holes in the button carries the risk of the button being damaged, the needle being broken and/or the button not being sewn on the article.

U.S. Pat. No. 4,690,077 to Nirenberg discloses a button delivery system for sewing machines. This patent describes a system which allows buttons to pass from a button supply hopper through a flexible chute into a button feeding mechanism. The button feeding mechanism, typically actuated by the operator of the sewing machine, causes a properly oriented button, previously positioned therein, to be moved into position for sewing. In order to cause the button to become properly oriented within the button feeding mechanism, as the button is pushed through the button feed path, pressure on the button upper surface at one side of the button feed path results in the button rotating around its axis transverse to the feed path. As the button rotates, two pins rest against the lower surface of the button until the holes in the button become aligned with the pins. At this point the pins enter the holes, thereby to prevent the button from rotating further, so that it is fed in the proper orientation to the sewing machine. The pins are, of course, withdrawn from the holes prior to the sewing operation.

More particular, the button guide turning assembly includes a frame or turning plate and a pair of elongate, spaced apart, parallel button guides which, together, define a channel through which the buttons pass in the automatic button feeding system. One of the guides exerts a greater friction on the buttons than the other of the guides, thereby to cause the buttons to rotate. Means are provided to secure each of the guides to the frame in a selected position. The securing means for one of the guides releasably secures the one guide to the frame and, when released, enabling repositioning of the one guide relative to the frame to a different selected position, thereby enabling the channel to accommodate buttons of different diameter. Preferably each button guide is mounted on the frame such that the button guides have a 0.006 inch clearance (0.15 millimeters) on each side of the button diameter, this clearance being about the thickness of two sheets of newspaper.

The buttons of a given manufacturing batch from the button maker are customarily of identical diameter, however, the buttons of a given button manufacturer may vary slightly in diameter from batch to batch, although nominally designated as the same diameter. Similarly the buttons from different button manufacturers will also vary from one manufacturer to another, despite having the same nominal diameter designation.

Accordingly, in order to avoid jamming of the button guide turning assembly or a failure of the button guide turning assembly to appropriately orient the buttons for the sewing operation, each of these being a possible result of improper setting of the button guides for a particular button diameter, it is customary to adjust the button guides of the button guide turning assembly as each new lot of buttons is introduced into the button delivery system. Such an adjustment can be laborious and time-consuming operation in view of the precision required and the necessity for accessing the button guides. The button guides are secured to the undersurface of a turning plate by means of screws, the screw heads being on the upper surface of the turning plate and extending downwardly through respective transverse slots in the turning plate into threaded holes at each end of each button guide. The turning plate partially blocks from view the operable portion of the button guides which can impede the adjustment of the button guides which have to be parallel to each other and which have to provide a small clearance about the button.

Typically both of the button guides are movable relative to the turning plate so that the center line of the button can be made coincident with the longitudinal center line of the turning plate. In order to do this, however, both button guides must be maintained equally spaced from the center line of the turning plate, thereby adding to the difficulty of the adjustment process.

Typically a variety of different gauges of different size are provided to the system operator, and the operator attempts to pick a gauge which will be appropriate for the particular button diameter of the new lot. Where the gauge is of the correct size for a particular button diameter, the button guides can be closed upon the gauge to effect a button guide separation which is appropriate for a button of that diameter (including the requisite clearances on either side of the button). However, since there are only a finite number of gauges and the variation in button diameter is infinite, in many instances a gauge for a particular size button cannot be selected and an approximation must be made. Errors in selecting an appropriate guide, as well as the inaccuracy inherent in the approximation process, can lead to an improper setting of the button guides with the aforementioned problems resulting therefrom.

Accordingly, it is an object of the present invention to provide a button guide turning assembly which is easily, rapidly and accurately adjustable for buttons of different diameter.

Another object is to provide such an assembly which is economical to manufacture and maintain.

SUMMARY OF THE INVENTION

The above and related objects of the present invention are obtained in a button guide turning assembly for an automatic button delivery system for delivering buttons from a button supply serially in a given orientation to button affixing apparatus. In its conventional aspects the assembly comprises a frame and a pair of elongate, spaced apart, parallel button guides together defining a channel through which the buttons pass in the automatic button delivery system. One of the guides exerts greater friction on the buttons than the other of the guides, thereby to cause the buttons to rotate as they move through the channel. Securing means secure each of the guides to the frame in a selected position, the securing means for one of the guides releasably securing the one guide to the frame and, when released, enabling repositioning of the one guide relative to the frame to a different selected position. The assembly additionally comprises a pair of elongate, spaced apart, parallel calibration means together defining at least one button-receiving area. Each calibration means is secured to a respective one of the guides for movement as a unit therewith, the calibration means being configured and dimensioned such that, when they abut a button in the button-receiving area, the guides are appropriately positioned to pass buttons of like diameter through the channel with an appropriate clearance.

In a preferred embodiment the calibration means are disposed on an opposite surface of the frame from the guides. The frame defines a transverse slot adjacent each end of each calibration means to enable adjustment of the spacing between the pair of calibration means and therefore between the guides. The securing means extends from each end of each calibration means through a respective one of the frame slots and into its respective guide to releasably secure each of the guides to the frame and, when released, enables repositioning of each of the guides relative to the frame to a different selected position.

The pair of calibration means together preferably define a button-receiving area adjacent each end thereof, the calibration means being configured and dimensioned such that, when they abut buttons of the same diameter in each of the button-receiving areas, the guides are parallel and appropriately positioned to pass buttons of like diameter through the channel. In use, each of the button-receiving areas has a button of the same diameter therein, and each of the calibration means abuts one of such buttons adjacent each end thereof.

Means are also disposed in the button-receiving areas for laterally positioning (i.e., centering) a button being placed therein.

BRIEF DESCRIPTION OF DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 1 is a top isometric view of a button guide turning assembly according to the present invention, showing in phantom line a button being turned, FIG. 2 is a bottom isometric view thereof;

FIG. 3 is a sectional view thereof, taken along the line 3—3 of FIG. 1; and FIG. 4 is a sectional view thereof, taken along the line 4—4 of FIG. 1.

DETAILED DESCRIPTION OF THE PREFERRED EMBODIMENTS

Referring now to the drawing, in particular to FIGS. 1 and 2 thereof, therein illustrated is a button guide turning assembly, generally designated by the reference numeral 10, according to the present invention. The assembly 10 is part of a conventional automatic button delivery system for delivering buttons from a button supply serially in a given orientation to button fixing apparatus, as described in Nirenberg U.S. Pat. No. 4,690,077, issued Sept. 1, 1987, the disclosure of which is incorporated herein by reference.

In its conventional aspects the assembly 10 comprises an elongate frame or turning plate 12 having a longitudinal axis parallel to that of the button path through the button guide turning assembly 10. The turning plate 12 defines, adjacent each end thereof, a pair of slots 14 extending generally perpendicular or transverse to the button travel path. Disposed beneath the turning plate 12 (above it in the bottom view of FIG. 2) are a pair of elongate, spaced apart, parallel button guides 20, 20' which together, define a channel 22 through which the buttons 24 pass in the automatic delivery system. One of the guides 20' supports a movable rigid portion 26, called a turning pad, which is mounted on a plurality of downwardly extending posts 27 and biased upwardly by springs 28 (locked in position on posts 27 by a locking wire 29) against the button lower surface. Thus guide 20' containing the turning pad 26 exerts greater friction on a button 24 passing through channel 22 than the other guide 20, thereby causing the button 24 passing through the channel 22 to rotate about an axis perpendicular to the longitudinal axis of channel 22.

Means are provided for securing each of the guides 20 to the turning plate 12 in a selected position. The illustrated securing means are screws generally designated 32, each screw having its head 34 disposed above the upper surface of the turning plate, its shank 36 passing through the transverse slots 14 of the turning plate 12, and its threaded end 38 disposed in a guide 20. When the screws 32 are tightened at each end of a guide 20, the guide 20 is fixedly positioned relative to the turning plate 12. When the screws 32 are loosened, it is possible to reposition the guide 20 relative to the turning plate 12 to a different selected position. As the button guide turning assembly described above is conventional in nature, fully described in U.S. Pat. No. 4,690,077, and well known to those skilled in the art, a further exposition of the details thereof (such as the mounting holes 39 of turning plate 12) is not deemed necessary herein.

The assembly 10 additionally includes a pair of elongate, spaced apart, parallel calibration plates generally designated 40 which, together, define a button-receiving area 42 at each end of the pair of button guides 20. Each calibration plate 40 is secured to a respective one of the button guides 20 for movement as a unit therewith. As illustrated, each calibration plate 40 is secured to its respective button guide 20 by means of screws 32, each of which passes downwardly through the calibration plate 40, a respective slot 14, and terminates in the button guide 20 therebelow. Further, the calibration plates 40 are configured and dimensioned such that, when they abut buttons 44 disposed in the button-receiving areas 42, the button guides 20 are parallel and appropriately positioned to pass buttons 24 of like diameter through the channel 22 defined thereby with a predetermined appropriate clearance on each side (generally about 0.15 mm).

The upper surface of the turning plate 12 is preferably provided adjacent each end with a pair of upwardly extending thin pins 50 which are adapted to receive thereon and laterally position (i.e., center) a button 40 being placed in the button-receiving area 42. The pins 50 serve as an automatically acting reference line 50 to facilitate adjustment of the calibration plates 40 so that the calibration plates 40 are maintained equidistantly laterally spaced from the reference line. This ensures appropriate lateral centering of the center line of buttons 44, and hence the button guides 20 so that the buttons 24 passing through channel 22 will be appropriately laterally centered for eventual feed to the sewing machine or other button-affixing apparatus (not shown).

The calibration plates 40 are disposed on the upper surface of the turning plate 12 and are thus more easily accessible than the button guides 20 which are disposed on the lower surface of the turning plate 12. While it is possible for the pair of calibration plates 40 to define but a single button-receiving area 42—for example, at a midpoint along the length of the channel 22—preferably the pair of calibration plates 40 defines a button-receiving area 42 adjacent each end thereof so that the button guides 20 are maintained parallel as well as appropriately positioned to pass buttons 24 of like diameter through the channel 22 with the predetermined appropriate clearance.

On the other hand, while a single calibration plate 40 is shown for each button guide 20, there may alternatively be two separate smaller calibration plates for each button guide 20, instead of a single large calibration plate 40, with one of the small calibration plates being secured separately to each end of a button guide 20. Further, while the connection between the calibration plate or plates 40 and the button guides 20 has been illustrated as screws 32 passing through the transverse slots 14 of the turning plate 12, clearly there is no requirement that the connection extend through the transverse slots 14 and, alternatively, the connection could extend, for example, about the ends of the turning plate 12.

As is conventional in button guide turning assemblies, and as shown in U.S. Pat. No. 4,690,077, means may be provided for fixing the orientation of a button 24 passing through the channel 22 once the desired orientation of the button 24 is achieved. For example, an upwardly biased member (not shown) with upstanding pins may be positioned under the button 24 so that, when the buttons 24 assume the desired orientation, the pins will enter the holes thereof and maintain them in the desired orientation for presentation to the sewing machine.

It will be appreciated that the button guide turning assembly 10 of the present invention may be adjusted for buttons of a given diameter without using any gauges and therefore without the need for any approximation in selecting an appropriate gauge for a particular button diameter.

To use the assembly 10, it is only necessary to loosen the four screws 32, replace the two buttons 44 on the pins 50 within the button-receiving areas 42 with the new buttons 44, move the calibration plates 40 into abutting relationship with the two buttons 44 in the button-receiving areas 42, and finally retighten the four screws 32.

To summarize, the present invention provides a button guide turning assembly which is easily, rapidly and accurately adjustable for buttons of different diameter, the assembly being economical to manufacture and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing disclosure.

I claim:

1. In a button guide turning assembly for an automatic button delivery system for delivering buttons from a button supply serially in a given orientation to a button affixing apparatus, comprising:

(A) a frame;

(B) a pair of elongate, spaced apart, parallel button guides together defining a channel through which the button pass in the automatic button delivery system, one of said guides exerting greater friction on the buttons than the other of said guides causing the buttons to rotate; and (C) means securing each of said guides to said frame in a selected position, said securing means releasably securing said one of said guides to said frame and, when released, enabling repositioning of said one guide relative to said frame to a different selected position;

the improvement wherein said assembly additionally comprises:

(D) a pair of elongate, spaced apart, parallel calibration means together defining at least one button-receiving area, each calibration means being secured to a respective one of said guides for movement as a unit therewith, said calibration means being configured and dimensioned such that, when both of said calibration means abut a button in said at least one button-receiving area, said guides are appropriately positioned to pass buttons of like diameter through said channel with an appropriate clearance.

2. The assembly of claim 1 wherein said calibration means are disposed on an opposite surface of said frame from said guides.

3. The assembly of claim 1 wherein said securing means releasably secures each of said guides to said frame and, when released, enables repositioning said each of said guides relative to said frame to a different selected position.

4. The assembly of claim 1 additionally including means disposed in each of said button-receiving areas for laterally positioning a button being placed therein.

5. The assembly of claim 1 wherein said pair of calibration means together define a button-receiving area adjacent each of two ends of said pair of calibration means, said calibration means being configured and dimensioned such that, when said pair of calibration means abut buttons of a same diameter in each of said button-receiving areas, said guides are parallel and appropriately positioned to pass buttons of like diameter through said channel.

6. The assembly of claim 5 wherein each of said button-receiving areas has a button of the same diameter therein, and each of said calibration means abuts one of such buttons adjacent each of said two ends thereof.

7. The assembly of claim 1 wherein said frame defines a transverse slot adjacent each of two ends of at least one of said calibration means to enable adjustment of the spacing between said pair of calibration means and therefore between said guides, and said securing means extends from each of said two ends of said at least one of said calibration means through one of said frame slots and into a respective guide.

8. In a button guide turning assembly for an automatic button delivery system for delivering buttons from a button supply serially in a given orientation to a button affixing apparatus, comprising:

(A) a frame;

(B) a pair of elongate, spaced apart, parallel button guides together defining a channel through which the buttons pass in the automatic button delivery system, one of said guides exerting greater friction on the buttons than the other of said guides causing the buttons to rotate; and (C) means securing each of said guides to said frame in a selected position, said securing means releasably securing said one of said guides to said frame and, when released, enabling repositioning of said one guide relative to said frame to a different selected position; and the improvement wherein said assembly additionally comprises:

(D) a pair of elongate, spaced apart, parallel calibration means together defining at least one button-receiving area, each calibration means being secured to a respective one of said guides for movement as a unit therewith, said calibration means being configured and dimensioned such that, when both of said calibration means abut a button in said at least one button-receiving area, said guides are appropriately positioned to pass buttons of like diameter through said channel; said pair or calibration means together defining a button-receiving area adjacent each of two ends of said pair of calibration means, each of said button-receiving areas having a button of a same diameter therein and means for laterally positioning the button therein, each of said calibration means abutting one of the same diameter buttons adjacent each of said two ends thereof, said calibration means being configured and dimensioned such that, when said pair of calibration means abut the same diameter buttons in each of said button-receiving areas, said guides are parallel and appropriately positioned to pass buttons of like diameter through said channel with an appropriate clearance;

said frame defining a transverse slot adjacent each of said two ends of at least one of said calibration means to enable adjustment of the spacing between said pair of calibration means and therefore between said guides, and said securing meaning extending from each of said two ends of said at least one of said calibration means through one of said frame slots and into at least a respective guide, releasably securing said guides and said calibration means on opposite surfaces of said frame, and, when released, enabling repositioning of said each of said guides and said calibration means relative to said frame to a different selected position.

9. In an automatic button delivery system for delivering buttons from a button supply serially in a given orientation to button affixing apparatus, including a button supply, a button affixing apparatus, and a button guide turning assembly, comprising:

(A) a frame;

(B) a pair of elongate, spaced apart, parallel button guides together defining a channel through which the buttons pass in the automatic button delivery system, one of said guides exerting greater friction on the buttons than the other of said guides causing the buttons to rotate; and (C) means securing each of said guides to said frame in a selected position, said securing means releasably securing said one of said guides to said frame and, when released, enabling repositioning of said one guide relative to said frame to a different selected position;

the improvement wherein said assembly additionally comprises:

(D) a pair of elongate, spaced apart, parallel calibration means together defining at least one button-receiving area, each calibration means being secured to a respective one of said guides for movement as a unit therewith, said calibration means being configured and dimensioned such that, when both of said calibration means abut a button in said at least one button-receiving area, said guides are appropriately positioned to pass buttons of like diameter through said channel with an appropriate clearance.

* * * * *